US008011129B2

(12) United States Patent
Cauley et al.

(10) Patent No.: US 8,011,129 B2
(45) Date of Patent: Sep. 6, 2011

(54) RECOIL-REDUCING SHOOTING REST

(75) Inventors: Dennis Cauley, Boonville, MO (US); Tim Morrow, Jefferson City, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 1574 days.

(21) Appl. No.: 10/865,595

(22) Filed: Jun. 10, 2004

(65) Prior Publication Data

US 2005/0000141 A1 Jan. 6, 2005
US 2007/0074439 A2 Apr. 5, 2007

Related U.S. Application Data

(60) Provisional application No. 60/478,557, filed on Jun. 13, 2003.

(51) Int. Cl.
*F41A 23/02* (2006.01)

(52) U.S. Cl. ..... 42/94; 42/97; 89/37.04; D22/108

(58) Field of Classification Search ..... 42/94, 97; 89/37.04; D22/108
See application file for complete search history.

(56) References Cited

U.S. PATENT DOCUMENTS

| | | | | |
|---|---|---|---|---|
| 197,397 | A | | 11/1877 | O'Neil |
| 387,411 | A | | 8/1888 | Gisel |
| 399,604 | A | | 3/1889 | Dufner et al. |
| 499,315 | A | | 6/1893 | Borchardt |
| 568,543 | A | | 9/1896 | Parks |
| 668,219 | A | | 2/1901 | Rock |
| 691,912 | A | | 1/1902 | McClean |
| 718,865 | A | | 1/1903 | Northcraft |
| 778,865 | A | | 1/1905 | Hyenga |
| 789,909 | A | | 5/1905 | Herold |
| 1,061,577 | A | | 5/1913 | Whitney |
| 1,088,362 | A | | 2/1914 | Perkins |
| 1,089,307 | A | * | 3/1914 | Benet et al. ..... 89/40.06 |
| 1,121,945 | A | | 12/1914 | Smith |
| 1,145,585 | A | | 7/1915 | Hebard |
| 1,175,692 | A | | 3/1916 | Boicourt |
| 1,187,325 | A | | 6/1916 | Ivey |
| 1,195,777 | A | | 8/1916 | Burtin |
| 1,250,215 | A | | 12/1917 | Panos |
| 1,256,255 | A | | 2/1918 | Porter |
| 1,295,688 | A | | 2/1919 | Butler |
| 1,367,353 | A | * | 2/1921 | Craig ..... 73/167 |
| 1,488,647 | A | | 4/1924 | Quinn |

(Continued)

FOREIGN PATENT DOCUMENTS

DE 838872 5/1952

(Continued)

OTHER PUBLICATIONS

Cabela's Hunting Fishing and Outdoor Gear Master Catalog, Fall 2002, Edition II, Minimizer Rifle Rest, Item No. SC-22-4333, p. 492.

(Continued)

*Primary Examiner* — Jamie Kucab
(74) *Attorney, Agent, or Firm* — Perkins Coie LLP

(57) ABSTRACT

A shooting rest supports a firearm and reduces recoil energy of the firearm. The shooting rest has a rear support and a front support for supporting the firearm and a frame connecting the rear support and the front support. The frame supports at least one weight to reduce the amount of recoil energy felt by a shooter.

11 Claims, 5 Drawing Sheets

U.S. PATENT DOCUMENTS

| | | | |
|---|---|---|---|
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,638,676 | A | 5/1953 | Callahan |
| 2,677,207 | A | 5/1954 | Stewart |
| 2,701,930 | A | 2/1955 | Dolan |
| 2,731,829 | A | 1/1956 | Wigington et al. |
| 2,740,530 | A | 4/1956 | Ponder |
| 2,753,642 | A | 7/1956 | Sullivan |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,112,567 | A | 12/1963 | Flanagan |
| 3,125,929 | A | 3/1964 | Peasley |
| 3,128,668 | A | 4/1964 | Dicken |
| 3,163,420 | A | 12/1964 | Braun |
| 3,175,456 | A | 3/1965 | Goodsell |
| 3,183,617 | A | 5/1965 | Ruger et al. |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,739,515 | A | 6/1973 | Koon, Jr. |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,877,178 | A | 4/1975 | Campanelli |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |
| 4,054,288 | A | 10/1977 | Perrine, Sr. |
| 4,055,016 | A | 10/1977 | Katsenes |
| 4,072,313 | A | 2/1978 | Murso et al. |
| 4,076,247 | A | 2/1978 | Kim et al. |
| 4,120,108 | A | 10/1978 | Vickers et al. |
| 4,120,276 | A | 10/1978 | Curran |
| 4,122,623 | A | 10/1978 | Stice |
| 4,143,491 | A | 3/1979 | Blanc |
| 4,177,608 | A | 12/1979 | Balz |
| 4,188,855 | A | 2/1980 | Alberts |
| 4,203,600 | A | 5/1980 | Brown |
| 4,206,573 | A | 6/1980 | Hayward |
| 4,222,305 | A | 9/1980 | Lee |
| 4,223,588 | A | 9/1980 | Simpson |
| 4,233,748 | A | 11/1980 | Ford et al. |
| D257,687 | S | 12/1980 | Bechtel |
| 4,266,748 | A | 5/1981 | Dalton |
| 4,282,671 | A | 8/1981 | Wood et al. |
| D260,650 | S | 9/1981 | Alviti |
| D261,794 | S | 11/1981 | Bechtel |
| 4,301,625 | A | 11/1981 | Rampe |
| 4,312,146 | A | 1/1982 | Koon, Jr. |
| 4,332,185 | A | 6/1982 | Hargrove |
| 4,333,385 | A * | 6/1982 | Culver ..... 89/37.04 |
| 4,338,726 | A | 7/1982 | Swailes |
| 4,340,370 | A | 7/1982 | Marshall et al. |
| 4,345,398 | A | 8/1982 | Pickett |

4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A * 10/1985 Rickling ..... 269/156
4,558,531 A 12/1985 Kilby
D283,561 S 4/1986 Geist et al.
4,601,124 A 7/1986 Brown, Jr.
4,608,762 A 9/1986 Varner
4,621,563 A * 11/1986 Poiencot ..... 89/37.04
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A * 1/1989 Nodo ..... 42/94
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A * 12/1991 Mueller ..... 42/94
5,074,188 A 12/1991 Harris
5,081,783 A * 1/1992 Jarvis ..... 42/94
5,117,850 A 6/1992 Money
5,123,194 A 6/1992 Mason
5,125,389 A 6/1992 Paff
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,622,344 A 4/1997 Gracie
5,628,135 A * 5/1997 Cady ..... 42/94
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor

| | | | | |
|---|---|---|---|---|
| 5,662,516 | A | | 9/1997 | You |
| 5,666,757 | A | | 9/1997 | Helmstadter |
| D387,123 | S | | 12/1997 | Hughes et al. |
| 5,703,317 | A | | 12/1997 | Levilly et al. |
| 5,711,102 | A | | 1/1998 | Plaster et al. |
| 5,715,625 | A | | 2/1998 | West, III |
| D391,616 | S | | 3/1998 | Plybon |
| 5,723,183 | A | | 3/1998 | Williams et al. |
| 5,723,806 | A | | 3/1998 | Odom |
| 5,737,865 | A | | 4/1998 | Brandl et al. |
| 5,740,625 | A | | 4/1998 | Jenkins |
| 5,758,447 | A | * | 6/1998 | Venetz ..... 42/94 |
| 5,761,954 | A | | 6/1998 | Dvorak |
| 5,778,589 | A | | 7/1998 | Teague |
| 5,779,527 | A | | 7/1998 | Maebashi |
| 5,811,720 | A | * | 9/1998 | Quinnell et al. ..... 89/37.04 |
| 5,813,131 | A | | 9/1998 | Werre |
| 5,833,308 | A | | 11/1998 | Strong, III et al. |
| D403,176 | S | | 12/1998 | Harper |
| 5,857,279 | A | | 1/1999 | de Oliveira Masina et al. |
| 5,875,580 | A | | 3/1999 | Hill et al. |
| 5,878,504 | A | | 3/1999 | Harms |
| 5,884,966 | A | | 3/1999 | Hill et al. |
| 5,899,329 | A | | 5/1999 | Hu et al. |
| 5,907,919 | A | | 6/1999 | Keeney |
| 5,913,667 | A | | 6/1999 | Smilee |
| 5,913,668 | A | | 6/1999 | Messer |
| 5,924,694 | A | | 7/1999 | Kent |
| 5,930,932 | A | | 8/1999 | Peterson |
| 5,933,997 | A | | 8/1999 | Barrett |
| 5,933,999 | A | | 8/1999 | McClure et al. |
| 5,959,613 | A | | 9/1999 | Rosenberg et al. |
| 5,970,642 | A | | 10/1999 | Martin |
| 5,974,719 | A | | 11/1999 | Simonek |
| 6,019,375 | A | | 2/2000 | West, Jr. |
| 6,021,891 | A | | 2/2000 | Anderson |
| 6,044,747 | A | | 4/2000 | Felts |
| 6,058,641 | A | | 5/2000 | Vecqueray |
| 6,073,381 | A | | 6/2000 | Farrar et al. |
| 6,086,375 | A | | 7/2000 | Legros |
| 6,110,020 | A | | 8/2000 | Rolfi |
| 6,121,556 | A | | 9/2000 | Cole |
| 6,254,100 | B1 | | 7/2001 | Rinehart |
| 6,260,463 | B1 | | 7/2001 | Brand et al. |
| 6,283,428 | B1 | | 9/2001 | Maples et al. |
| 6,289,622 | B1 | | 9/2001 | Desch, Jr. et al. |
| 6,293,041 | B2 | | 9/2001 | Weaver |
| 6,294,759 | B1 | | 9/2001 | Dunn, Jr. |
| 6,305,117 | B1 | | 10/2001 | Hales, Sr. |
| 6,309,476 | B1 | | 10/2001 | Ravenscroft et al. |
| 6,338,218 | B1 | | 1/2002 | Hegler |
| 6,390,294 | B1 | | 5/2002 | Fiore, Jr. et al. |
| 6,397,720 | B1 | | 6/2002 | Fox et al. |
| 6,439,515 | B1 | | 8/2002 | Powers |
| 6,517,133 | B2 | | 2/2003 | Seegmiller et al. |
| D471,248 | S | * | 3/2003 | Jacobs ..... D22/108 |
| 6,526,687 | B1 | | 3/2003 | Looney |
| D473,376 | S | | 4/2003 | Abate |
| 6,546,662 | B1 | | 4/2003 | Chong |
| 6,574,899 | B1 | | 6/2003 | Mostello |
| 6,575,469 | B2 | | 6/2003 | Love |
| 6,643,973 | B1 | | 11/2003 | Smith |
| 6,663,298 | B2 | | 12/2003 | Haney |
| 6,688,031 | B2 | | 2/2004 | Steele |
| 6,736,400 | B1 | | 5/2004 | Cesternino |
| 6,813,855 | B2 | | 11/2004 | Pinkley |
| 6,814,654 | B2 | | 11/2004 | Rolfi |
| 6,854,975 | B2 | | 2/2005 | Ranzinger |
| 6,860,054 | B1 | | 3/2005 | Mosher |
| 6,862,833 | B1 | | 3/2005 | Gurtner |
| 6,871,440 | B2 | | 3/2005 | Highfill et al. |
| 6,877,266 | B1 | | 4/2005 | Brownlee |
| 6,883,263 | B1 | | 4/2005 | Carrow |
| 6,931,777 | B1 | | 8/2005 | Krien |
| 6,953,114 | B2 | | 10/2005 | Wang et al. |
| D513,055 | S | * | 12/2005 | Lahti ..... D22/108 |
| 6,978,569 | B2 | | 12/2005 | Williamson, IV et al. |
| D519,183 | S | | 4/2006 | Minneman |
| 7,032,494 | B2 | | 4/2006 | Wygant |
| D521,100 | S | | 5/2006 | Morrow |
| 7,062,979 | B2 | | 6/2006 | Day et al. |
| D524,541 | S | | 7/2006 | Cauley |
| 7,086,192 | B2 | | 8/2006 | Deros |
| 7,104,398 | B1 | | 9/2006 | Wisecarver |
| 7,134,663 | B1 | | 11/2006 | Lowe et al. |
| 7,143,986 | B1 | | 12/2006 | Austin et al. |
| 7,152,355 | B2 | | 12/2006 | Fitzpatrick et al. |
| 7,152,358 | B1 | | 12/2006 | LeAnna et al. |
| D540,904 | S | | 4/2007 | Werner |
| 7,207,567 | B1 | | 4/2007 | Brown |
| 7,225,050 | B2 | | 5/2007 | Sutula, Jr. |
| D553,219 | S | | 10/2007 | Potterfield |
| D567,895 | S | | 4/2008 | Cauley |
| 7,357,250 | B2 | | 4/2008 | Hagemann et al. |
| 7,363,740 | B2 | | 4/2008 | Kincel |
| 7,401,431 | B2 | | 7/2008 | Pierce et al. |
| D576,245 | S | | 9/2008 | Potterfield et al. |
| 7,426,800 | B2 | | 9/2008 | Pierce et al. |
| 2002/0113372 | A1 | | 8/2002 | Love |
| 2004/0020097 | A1 | | 2/2004 | Deros |
| 2004/0134113 | A1 | | 7/2004 | Deros et al. |
| 2005/0000141 | A1 | | 1/2005 | Cauley et al. |
| 2005/0011101 | A1 | | 1/2005 | Gooder |
| 2005/0115137 | A1 | | 6/2005 | Minneman |
| 2005/0183319 | A1 | | 8/2005 | Franks |
| 2005/0188597 | A1 | | 9/2005 | Keng et al. |
| 2005/0242250 | A1 | | 11/2005 | Keng et al. |
| 2006/0174532 | A1 | | 8/2006 | Popikow |
| 2006/0175213 | A1 | | 8/2006 | Hurt et al. |
| 2006/0248774 | A1 | | 11/2006 | Pierce et al. |
| 2006/0248775 | A1 | | 11/2006 | Wade et al. |
| 2006/0254111 | A1 | | 11/2006 | Giauque et al. |
| 2006/0278797 | A1 | | 12/2006 | Keng et al. |
| 2007/0029733 | A1 | | 2/2007 | Anderson |
| 2007/0046760 | A1 | | 3/2007 | Zara |
| 2007/0068379 | A1 | | 3/2007 | Sween et al. |
| 2007/0074440 | A2 | | 4/2007 | Cauley |
| 2007/0094911 | A1 | | 5/2007 | Rush et al. |
| 2007/0113460 | A1 | | 5/2007 | Potterfield et al. |
| 2007/0175077 | A1 | | 8/2007 | Laney et al. |
| 2007/0256346 | A1 | | 11/2007 | Potterfield et al. |
| 2007/0262529 | A1 | | 11/2007 | Gamez et al. |
| 2007/0266610 | A1 | | 11/2007 | Coffield |
| 2007/0294929 | A1 | | 12/2007 | Potterfield et al. |
| 2007/0295197 | A1 | | 12/2007 | Potterfield |
| 2008/0023379 | A1 | | 1/2008 | Potterfield et al. |
| 2008/0023915 | A1 | | 1/2008 | Morrow et al. |
| 2008/0034636 | A1 | | 2/2008 | Potterfield et al. |
| 2008/0041700 | A1 | | 2/2008 | Potterfield et al. |
| 2008/0047189 | A1 | | 2/2008 | Potterfield et al. |
| 2008/0054570 | A1 | | 3/2008 | Potterfield et al. |
| 2008/0061509 | A1 | | 3/2008 | Potterfield |
| 2008/0127815 | A1 | | 6/2008 | Yale et al. |
| 2008/0168697 | A1 | | 7/2008 | Potterfield et al. |
| 2008/0174071 | A1 | | 7/2008 | Potterfield et al. |
| 2009/0049731 | A1 | | 2/2009 | Seuk |
| 2009/0056192 | A1 | | 3/2009 | Oz |
| 2009/0126250 | A1 | | 5/2009 | Keng |

FOREIGN PATENT DOCUMENTS

| | | |
|---|---|---|
| EP | 0624455 | 11/1994 |
| GB | 475080 | 11/1937 |

OTHER PUBLICATIONS

Cabela's Hunting Fishing and Outdoor Gear Master Catalog, Fall 2002, Edition II, Minimizer Rifle Rest, Item No. SC-22-4332, p. 492.

Battenfeld Technologies, Inc., "Steady Rest Portable Shooting Rest," file://C:\DOCUME~1\DUTCD\LOCALS~\Temp\PQ28V28J.htm, 1 page, accessed Jan. 25, 2006.

Lahti Company, Evaluator Brochure, http://www.lathicompany.com/Forms/EvaluatorBrochure2.jpg, 2 pages, accessed Jan. 16, 2006.

Ellett Brothers, Rests & Gun Vises, 3 pages.

AcuSport, Outdoor Sporting Products, 3 pages.

Californiavarmintcallers.com—forum, http://californiavarmintcallers.com/community/modules/newbb/viewtopic.php?topic_id=10&forum=9&PHPSESSID=074ed8c7..., pp. 1-4, accessed Jan. 16, 2006.

"American Rifleman: What to do about recoil," LookSmart, http://www.findarticles.com/p/articles/mi_qa3623/is_199907/ai_n8861959/print, pp. 1-4, accessed Jan. 4, 2006.
Tenex Precision Co., "Recoil A-Rest-R," Product Pictures, 4 sheets, Riverside, CA.
"Cleaning Cradles: Sinclaire Cleaning Cradles" p. 21. 1 page. The date on which the Sinclair Folding Cleaning Cradle was first on sale is not known, but is believed to be circa 2004.
Midway USA. "Tipton Range Box with Ultimate Rifle, Handgun Cleaning Kit (No Solvents)". <URL: http://www.midwayusa.com/rewriteaproduct/135086>. 2 pages. The date on which the Tipton Range Box was first on sale is not known, but is believed to be circa 2004.
MTM Case-Gard. "Gun Maintenance Centers." 2 pages. The date on which the MTM Gun Maintenance Center was first on sale is not known, but is believed to be circa 2004.
MTM Case-Gard. "Rifle rest and pistol shooting rest". <URL: http://www.mtmcase-gard.com/products/shooting/shoo.html>. 3 pages. The date on which the MTM Site-In-Clean was first on sale is not known, but is believed to be circa 2004.
The Sportsman's Guide. "Plano Shooters Case!" <URL: http://www.sportsmansguide.com/cb/cb.asp?a=148225>. 3 pages. The date on which the Plano Shooters Case was first on sale is not known, but is believed to be circa 2004.
Four photos of the Lohman Sight Vise. The date on which the Lohman Sight Vise was first on sale is not known, but is believed to be circa 2004.
U.S. Appl. No. 11/271,100, Cauley.
"Decker Rifle Vise". 1 page. The date on which the Decker Rifle Vise was first on sale is not known, but is believed to be circa 2004.
1Shop2.com. "Hoppe's Gunsmith's Fully Adjustable Bench Vise" 3 pages. The date on which The Hoppe's Gunsmith's Fully Adjustable Bench Vise was first on sale is not known, but is believed to be circa 2004.
Cabela's: World's Foremost Outfitter. "HySkore Sighting System and Cleaning Vise". 1 page.The date on which the HySkore Sighting System and Cleaning Vise was first on sale is not known, but is believed to be circa Jan. 2005. However, a prototype of this product may have been shown to buyers at Cabela's circa Aug. 2004.
Cabela's. "Master Catalog Fall 2003: Late-Season Edition". Cover page and p. 416. 2 pages.
Brownells. Catalog No. 57. For 2004-2005. 2 pages.
MTM Shoulder-Gard Rifle Rest, MTM Case-Gard, p. 2 "Rests".
Device manufactured by Shooter's Ridge, a division of ATK, and available at least by late 2005.
U.S. Appl. No. 12/476,041, filed Jun. 1, 2008, Cauley.
Final Office Action; U.S. Appl. No. 11/206,430; Mailed on Nov. 24, 2008, 12 pages.
Final Office Action; U.S. Appl. No. 11/339,863; Mailed on Mar. 10, 2009, 6 pages.
Final Office Action; U.S. Appl. No. 11/505,784; Mailed on Dec. 19, 2008, 10 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/853,763; Mailed on Jul. 13, 2009, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.
Non-Final Office Action; U.S. Appl. No. 11/679,169; Mailed on Apr. 28, 2009, 11 pages.
Non-Final Office Action; U.S. Appl. No. 11/801,341; Mailed on Jan. 13, 2009, 7 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/117,668; Mailed on Aug. 13, 2009, 15 pages.
Non-Final Office Action; U.S. Appl. No. 11/679,832; Mailed on Aug. 28, 2009, 9 pages.
U.S. Appl. No. 11/431,956, filed May 10, 2006, Morrow et al.
U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
Amazon.com, "Eforcity Magnetic Screwdriver Set w/15 bits; Great for Cellphones, Computers; Includes: T6, TORX, Security TORX, Philips, Slotted, Spanner, Tri-Wing, Bent Pry Tool, Round Awl, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, Instra-View™ Targets, 1 page.
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Milek, B., "Handloading for Hunting New Products from RCBS, Lee, Accurate Arms," Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].

Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press... Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Caldwells Insta-View 4" Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71.
"Reloading Manual Number Ten for Rifle and Pistol," The Cartridge Components, SPEER Omark Industries, pp. 28-54.
"Shotshell reloading with a GRABBER 76," MEC—Mayville Engineering Company, Inc., pp. 1-12.
Sweeney, P "Gunsmithing: Measure Headspace, Peterson's Rifleshooter," http://www.rifleshootermag.com/gunsmithing/headspace_0612/, 4 pages [Internet Accessed Dec. 11, 2004].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
"Uncle Bud's Udder Bag," http:www.unclebudscss.com/pages/Udder%20Bags.html, 2 pgs. [Internet accessed on Feb. 14, 2006].
"Uncle Bud's Bull Bags," http:www.unclebudscss.com/pages/Bulls%20bags.html, 2 pgs. [Internet accessed on Feb. 14, 2006].
Millet, "BenchMaster Shooting Rests," 1 page, Undated.
Protektor Model, "The Original Leather Rifle and Pistol Rest" http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product__info.php?products__id=..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4FOLP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=..., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, ® 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabeles/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproduct.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproduct.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproduct.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproduct.exe/showproduct?saleitemid=729197&t=11082005, 2005, 3 pages [Internet accessed on Aug. 6, 2008].

MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Amazon.Com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon/com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works...," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup_2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-_7gnY4CFRVNhgodjFhfSQ, 29 pages [Internet accessed on Aug. 30, 2007].
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 11/339,863; Mailed on Sep. 23, 2008, 7 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Final Office Action; U.S. Appl. No. 11/271,100; Mailed on Sep. 22, 2008, 8 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
"Cabela's Rotary Media Separator," http://www.cabelas/en/templates/links/link.jsp;jsessionid=QYVQMKM0P0P5.., 2 pages [Internet accessed Apr. 24, 2007].
RCBS, "Reloading Equipment," http://www.rcbs.com/default.asp?menu=1&s1=4&s2=3&s3=25, 1 page [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 13 pages.
International Search Report and Written Opinion; International Patent Application No. PCT/US07/76440; Filed: Aug. 21, 2007; Applicant: Battenfeld Technologies, Inc.; Mailed on Sep. 30, 2008.
Non-Final Office Action; U.S. Appl. No. 11/679,100; Mailed on Oct. 16, 2008, 11 pages.
U.S. Appl. No. 12/209,113, filed Sep. 11, 2008, Potterfield et al.
U.S. Appl. No. 12/276,223, filed Nov. 21, 2008, Potterfield et al.
U.S. Appl. No. 12/276,229, filed Nov. 21, 2008, Cauley et al.

* cited by examiner

RECOIL-REDUCING SHOOTING REST

CROSS-REFERENCE TO RELATED APPLICATIONS

This application is a non-provisional of U.S. Provisional Patent Application Ser. No. 60/478,557, filed Jun. 13, 2003. The entire text of which is hereby incorporated herein by reference.

BACKGROUND OF THE INVENTION

This invention relates generally to a firearm shooting rest, and more particularly to a shooting rest that reduces the amount of recoil energy transmitted to a shooter.

The firearms shooting sports are often associated with the sometimes painful recoil that results from shooting the firearm. Recoil from large caliber firearms can cause a shooter to flinch, or jerk the firearm trigger, in anticipation of the shock to the shooter's upper body. Flinching, or jerking the trigger, in anticipation of recoil is a common negative factor in a shooter's accuracy. Recoil can be described as the equal and opposite reaction to the momentum of an ammunition cartridge's projectile (bullet) and gunpowder charge upon firing of the cartridge. This momentum is imparted to the firearm, causing it to travel in the opposite direction of the fired bullet. The resulting energy, or recoil energy, of the firearm can be calculated using the following equation derived from the Law of Conservation of Momentum:

$$\text{Recoil Energy (ft-lbs)} = \frac{(\text{Bullet Weight} \times \text{Bullet Velocity} + 4700 \times \text{Gunpowder Weight})\text{^}2)}{64.348 \times \text{Firearm Weight}}$$

Where 4700 is the velocity of the gases generated by the burning gunpowder and 64.348 is a correction factor for the acceleration of gravity.

As can be seen by the above equation, increasing the Firearm Weight will result in a decreased Recoil Energy. As is common to the art of firearms manufacture, large caliber, heavy recoiling firearms are designed to be heavier in weight than small caliber, low recoiling firearms for precisely this reason. The additional weight has a dampening effect on the recoil felt by the shooter.

To test the accuracy of a firearm a shooter will commonly shoot with the firearm placed atop a shooting rest, which in turn is placed atop a bench. The shooter then fires the firearm from a sitting position behind the bench. This type of arrangement eliminates shooting errors caused by the inability of the human body to hold a firearm perfectly steady and provides the steadiest, most accurate method of supporting a firearm while shooting. Shooting from the bench has the drawback of subjecting the shooter to a higher degree of "effective recoil." Actual recoil energy of the firearm does not increase by shooting from the bench, but more of the recoil energy is transferred to the shooter in a sitting position than in a standing position. The standing position allows the entirety of the shooter's body to flex and partially absorb the recoil energy. In the sitting position only the torso (shoulder to waist) of the shooter is available to flex and absorb the recoil. Because of the higher "effective recoil" when firing from a sitting position, shooting a large caliber, heavy recoiling firearm from a bench can create an unpleasant experience when firing more than a few rounds. It is common for a shooter to fire upwards of twenty rounds when zeroing, or sighting-in, especially in the case of rifles and shotguns using telescopic sights.

From this point forward the discussion of firearms will pertain specifically to long arms (e.g., rifles and shotguns) although many of the principles discussed could be applied to other types of firearms.

This invention relates to a method of reducing recoil experienced by the shooter without requiring modification to the firearm. Several devices are currently available that serve as a means of supporting a firearm on a bench while reducing recoil. These recoil-reducing shooting rests differ from traditional shooting rests in that the traditional rests do nothing to absorb recoil. A traditional shooting rest supports and steadies the firearm, but does not restrain it. A recoil-reducing shooting rest may employ any of a multitude of methods to dampen, or absorb the recoil energy. Typically these devices consist of a base unit with a moveable carriage, with the firearm resting on and affixed to the carriage. The carriage is moveably attached to the base to allow linear motion relative to the base along a path parallel to the direction of firearm recoil. Springs, pneumatic cylinders, elastic bands or other methods with which to slow, or dampen, the force and energy of the recoiling firearm, restrain the carriage, and the firearm affixed to the carriage, from free travel relative to the base. Reference may be made to U.S. Pat. No. 5,811,720, incorporated by reference herein for all purposes, for additional background information relating to existing recoil-reducing shooting rests.

The present invention reduces recoil by adding weight to the shooting rest. The shooting rest is a rigid structure. Therefore, when the firearm is fired, the firearm and shooting rest can be considered as a single unit subjected to the firearm's recoil energy. Mathematically, the weight of the shooting rest can be added to the weight of the firearm to yield a total Firearm Weight as used in the Recoil Energy equation. Since total Firearm Weight is inversely proportional to recoil energy, adding more weight to the shooting rest results in a corresponding reduction in recoil energy. The recoil-reducing shooting rest of the present invention is designed to accept 25 lb. bags of lead shot to increase the weight of the unit. Lead shot was selected for its availability to the typical shooter, uniformity of packaging and ease of portability.

SUMMARY OF THE INVENTION

The objectives of the present invention include one or more of the following:

1) A shooting rest that provides recoil reduction for heavy recoiling firearms;

2) Recoil reduction in the simplest manner possible;

3) A rigid shooting rest to withstand the energy of heavy recoiling firearms;

4) A stable shooting rest;

5) A shooting rest with few moving parts;

6) A quality product with minimal cost

The present invention is designed to reduce the recoil energy experienced by a shooter when shooting heavy recoiling rifles and shotguns from a sitting position at a bench while providing a solid, steady support for the firearm. In one embodiment, the Recoil-Reducing Shooting Rest is of a rigid design and constructed of steel tubing and sheet metal. The rest includes a stationary Rear Support for the buttstock of a firearm, an adjustable Front Support for the forend of the firearm, a stabilizing Frame connecting the Rear and Front Supports and a formed sheet metal Holder located in the center of the frame. The purpose of the holder is to hold weight added by the shooter. In one embodiment, the holder is designed to hold up to four 25 lb. bags of lead shot or other suitable material. The weight of the lead shot reduces recoil energy generated by offering resistance to the rearward movement of the firearm and Shooting Rest upon discharge of the firearm.

Other objects and features will be in part apparent and in part pointed out hereinafter.

BRIEF DESCRIPTION OF THE DRAWINGS

Corresponding parts are designated by corresponding reference numbers throughout the drawings.

DESCRIPTION OF THE PREFERRED EMBODIMENT

Figure 1:
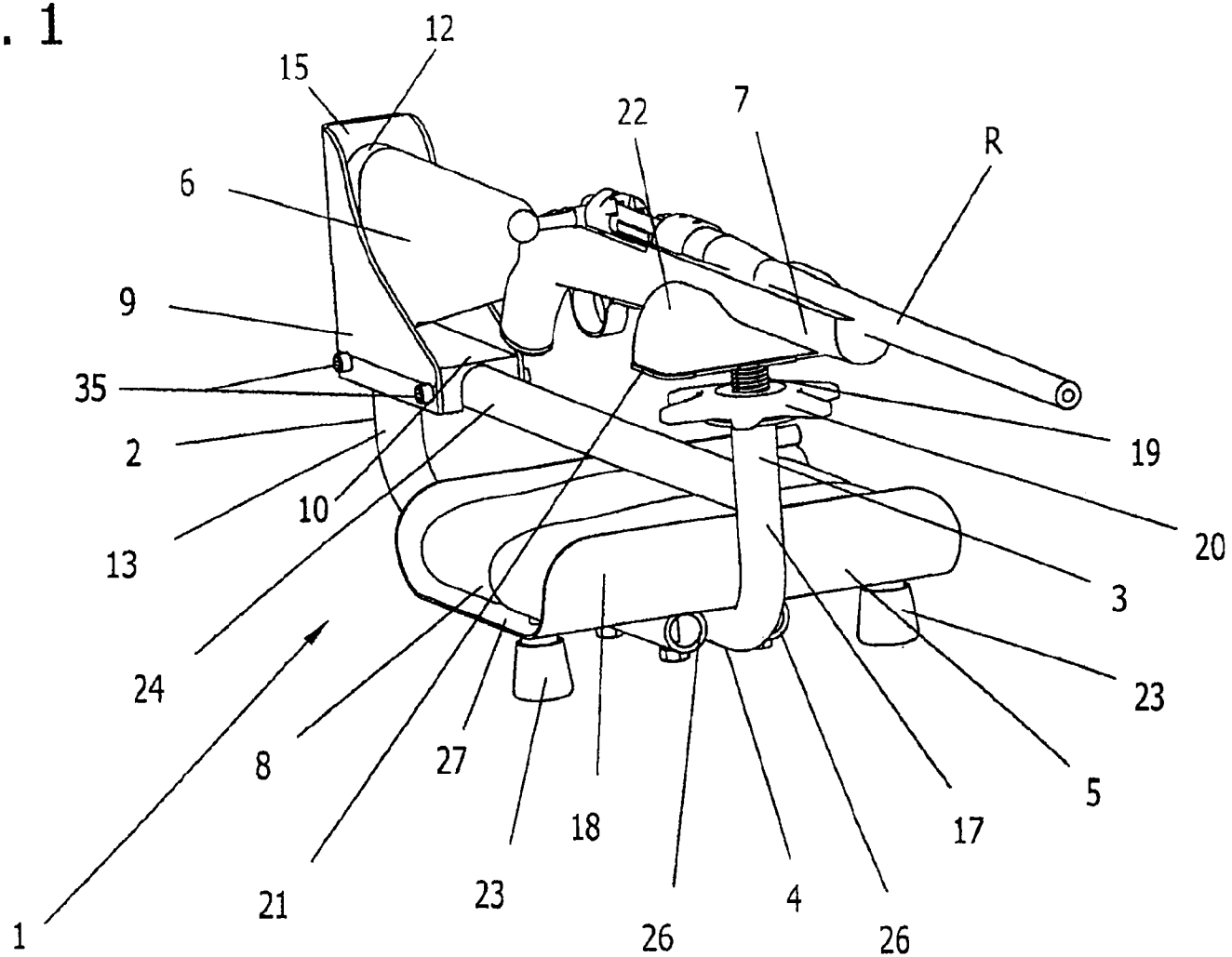
FIG. 1 is a perspective view of one embodiment of a recoil-reducing shooting rest of the present invention with a rifle mounted in a firing position.
Figure 2:
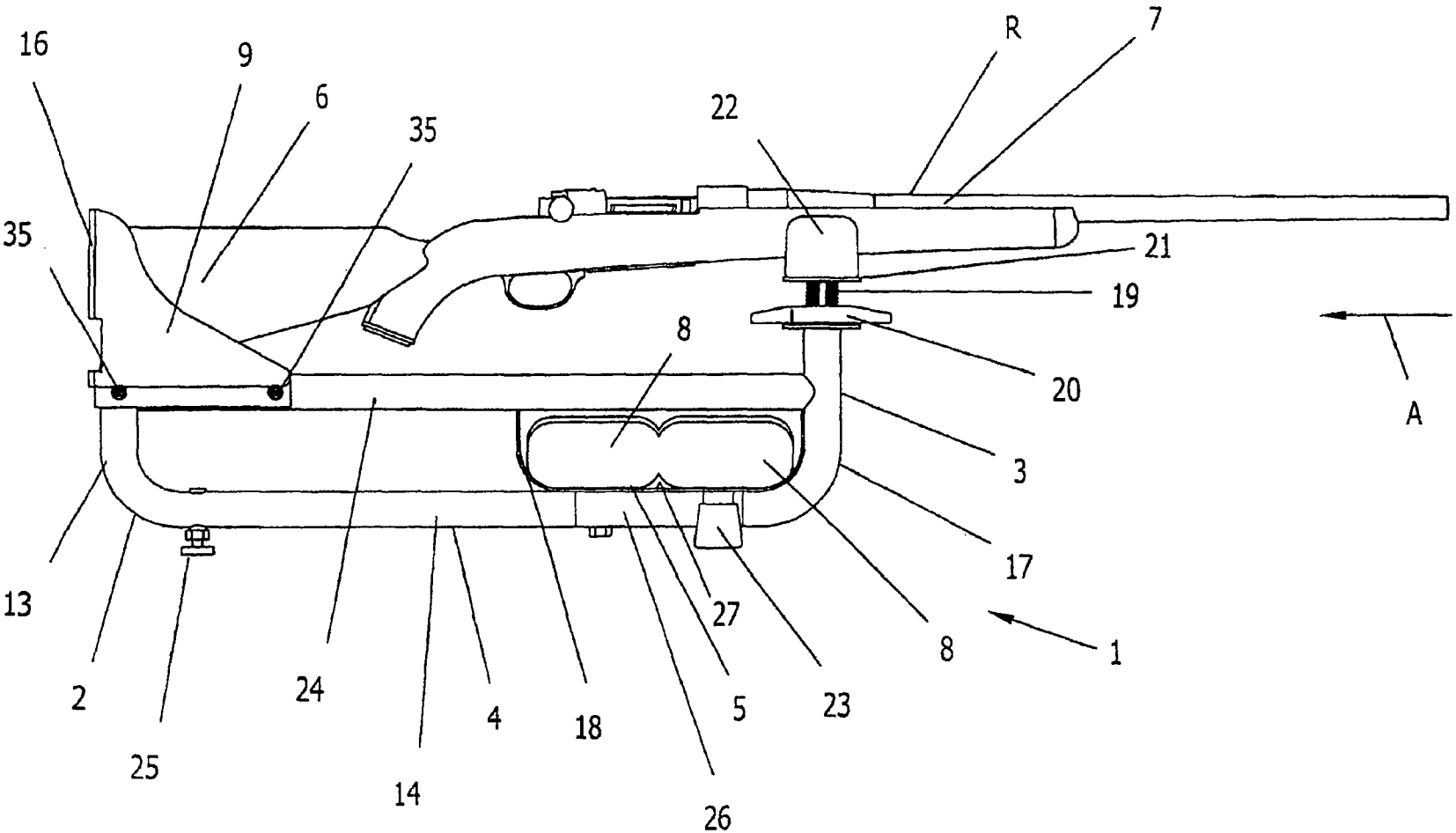
FIG. 2 is a side view of the shooting rest of FIG. 1.
Figure 3:
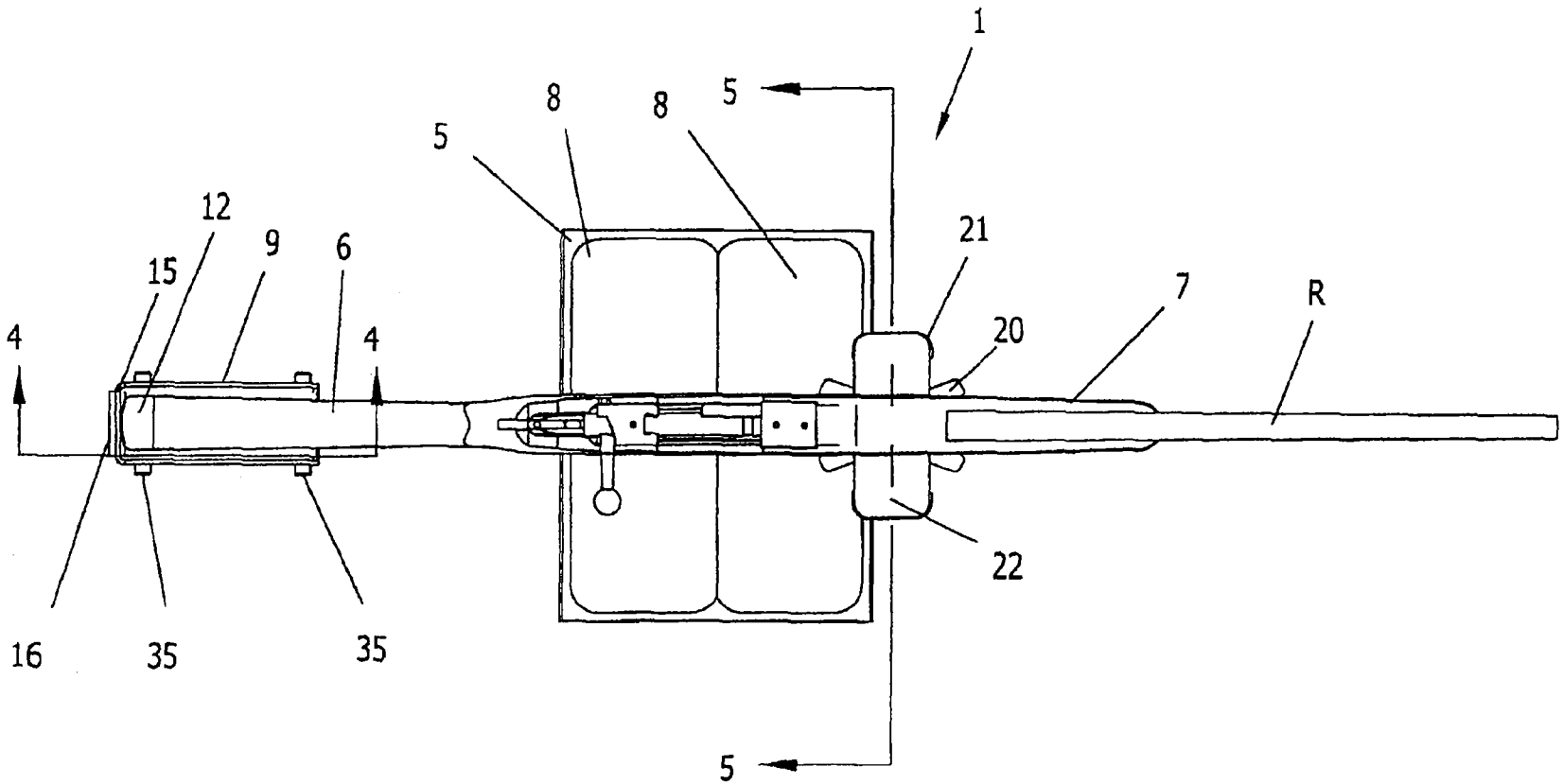
FIG. 3 is a top view of the shooting rest of FIG. 1.

FIGS. 1 through 3 illustrate one embodiment of the present invention from varying angles with a firearm (rifle) R placed atop the unit in the shooting position. The Recoil-reducing Shooting Rest (Shooting Rest), generally designated 1, includes four main subsystems, namely, a Rear Support 2, a Front Support 3, a Frame 4 and a Holder 5. The Rear Support 2 supports a buttstock 6 of the rifle R and the Front Support 3 supports the forend 7 of the rifle. The Frame 4 connects the Rear Support 2, Front Support 3 and Holder 5 so that the Shooting Rest 1 is a single, rigid unit.

In one embodiment the Frame 4 is constructed of steel tubing and comprises a Rear Vertical Section 13, a Horizontal Base Section 14, a Front Vertical Section 17, and a Horizontal Support Member 24. The Frame 4 provides a rigid infrastructure to the Shooting Rest 1 by joining all the subsystems in a single unit. Preferably, the Rest 1 has three points of contact with a bench or other flat surface but it will be understood that the Shooting Rest may have more or less than three points of contact with the bench without departing from the scope of this invention. In the illustrated embodiment, a Rear Foot 25 is located on the Horizontal Base Section 14 of the Frame 4, generally near the rear of the Shooting Rest 1 and two Front Feet 23 are located toward the outside edges of the Holder 5. A three-point contact, or tripod arrangement, provides the most inherently stable and self-leveling configuration of the Shooting Rest 1. The Front Feet 23 and Rear Foot 25 provide a non-marring surface for contact of the Shooting Rest 1 with the bench and also provide a large coefficient of friction between the Shooting Rest and the bench to minimize movement of the Shooting Rest during firearm discharge. The Rear Foot 25 is threadably engaged to the Horizontal Base Section 14. The threaded engagement allows for elevation adjustment for the rear portion of the Rest 1. The Front Feet 23 are attached to the Holder 5 by conventional fasteners (e.g. sheet metal screws not shown).

Figure 4:
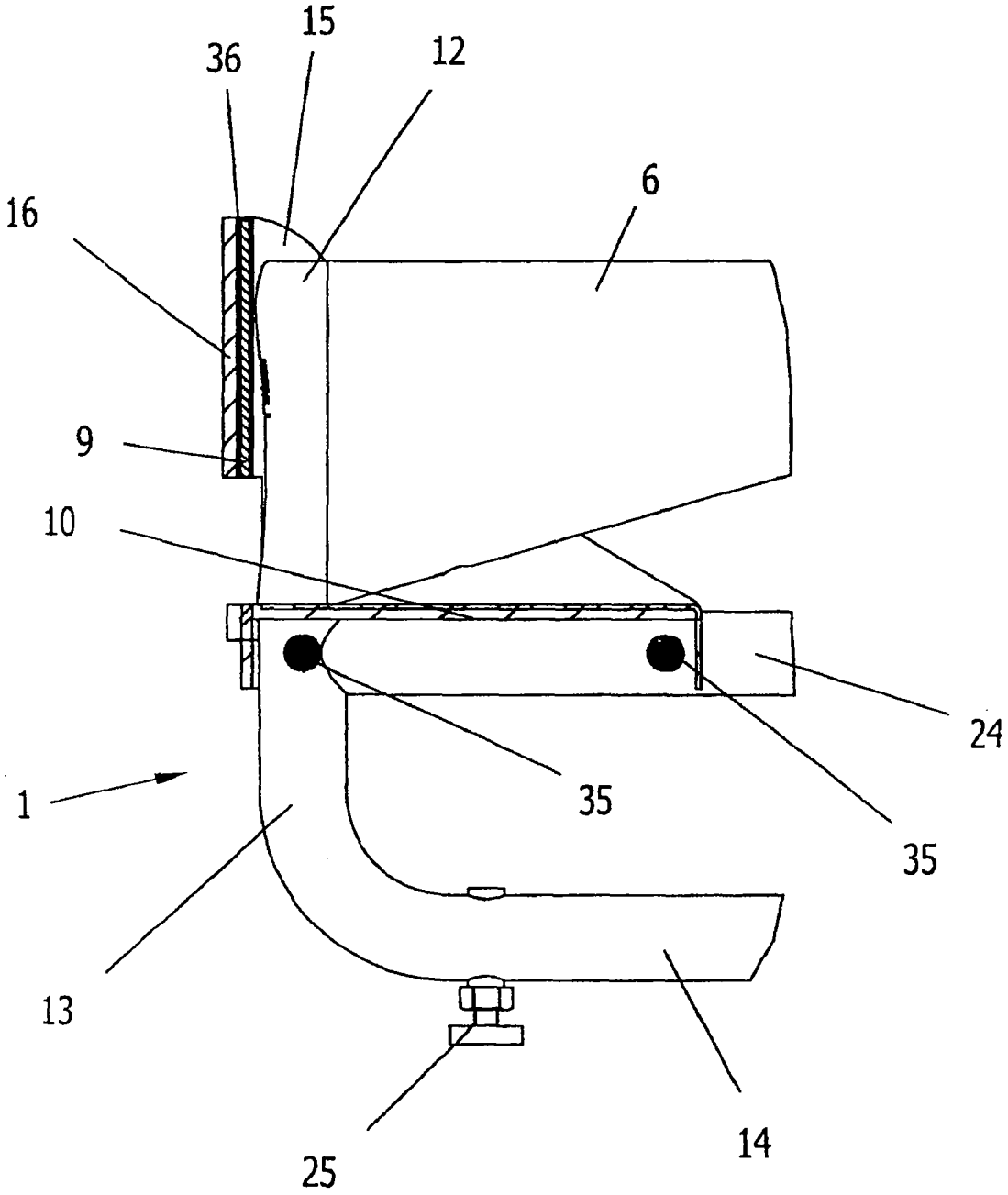
FIG. 4 is a detailed section view of a portion of the shooting rest taken along the plane including line 4-4 of FIG. 3.

The Rear Support 2 supports the rifle buttstock 6 and provides the main transfer point of the recoil energy from the rifle R to the Frame 4 of the Shooting Rest 1. In the illustrated embodiment, the Rear Support 2 consists of a Buttstop 9, Toe Plate 10 and a Recoil Shoulder Pad 16. As seen in FIG. 4 the rifle buttstock 6 rests atop the Toe Plate 10 with the rear surface of the buttstock, called a buttplate 12, contacting the inside surface 15 of the Buttstop 9. In one embodiment, the Buttstop 9 is formed from sheet metal and has two side panels and a rear panel that contacts the rear surface of the rifle buttstock 6. The Buttstop 9 is rigidly connected to the Toe Plate 10, the Rear Vertical Section 13 of the Frame 4, and the Horizontal Support Member 24 of the Frame 4. In one embodiment, the Buttstop 9 and Toe Plate 10 are fixed to the Rear Vertical Section 13 and Horizontal Support Member 24 of the Frame 4 by threaded fasteners (e.g., bolts 35 in FIG. 4). Firing the rifle R will cause the rifle to translate in a rearward direction, as indicated by arrow A in FIG. 2. With the rifle buttplate 12 in contact with the inside surface 15 of the Buttstop 9 the recoil energy of the rifle R will be transferred to the Buttstop 9, and therefore to the entire Shooting Rest 1. The Recoil Pad 16 comprises a resilient foam pad attached (e.g. sewn) to a thin nylon sleeve 36 that fits over the Buttstop 9 to provide a soft, comfortable surface to the shooter's shoulder (FIG. 4). The nylon sleeve 36 covers the inside surface 15 of the Buttstop 9 to provide a non-marring surface for contact with the Buttplate 12 of the firearm R.

Figure 5:
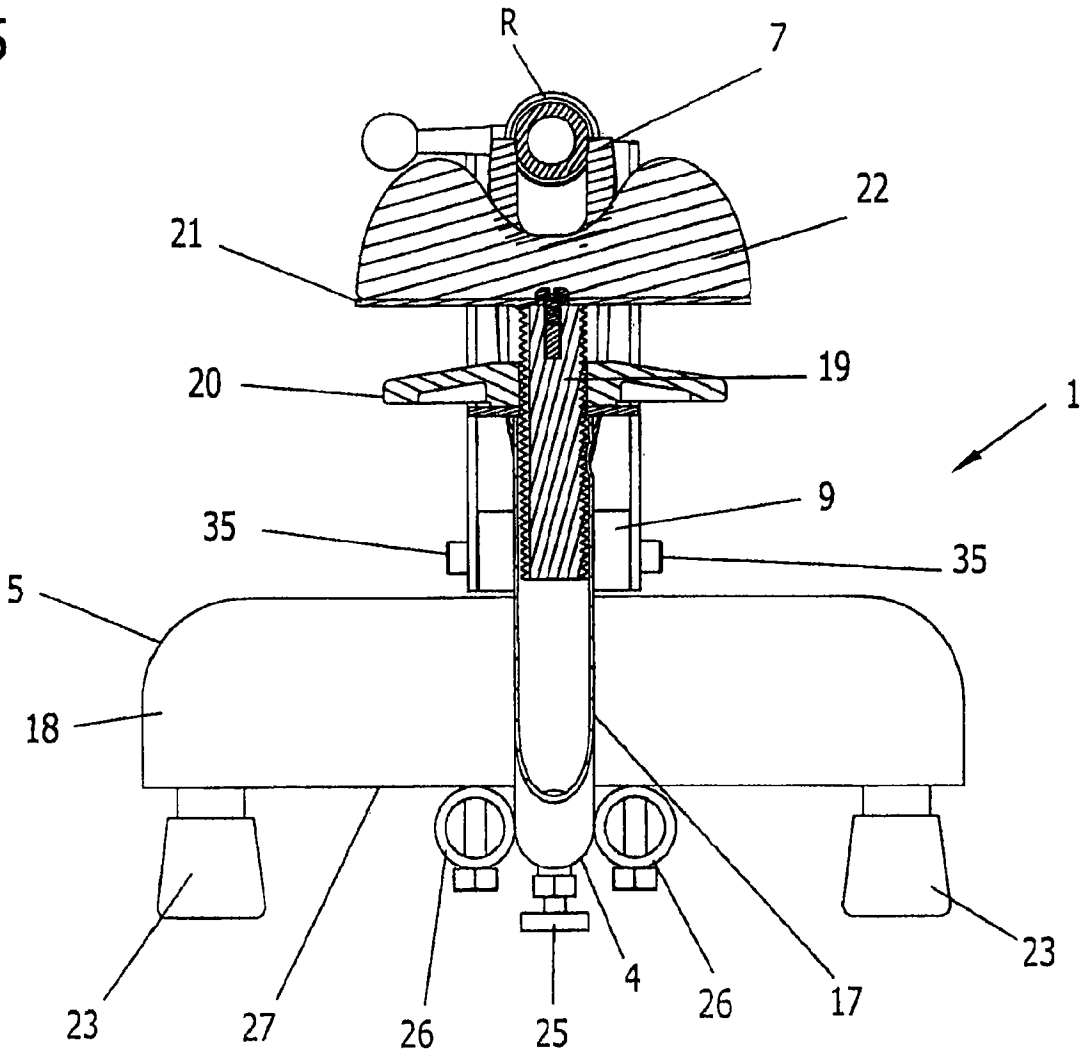
FIG. 5 is a section view taken along the plane including line 5-5 of FIG. 3.

Referring to FIGS. 1, 2, and 5, the Front Support 3 functions as a vertically adjustable (elevation adjustment) support for the rifle's forend 7. The specific component parts for the Front Support 3 are typical to other shooting rests designs known in the art. As shown in FIG. 5, a cylindrical, threaded Ram 19 is removably inserted into an open end of the Front Vertical Section 17 of the Frame 4. A threaded Adjustment Wheel 20 rests atop the end of the Front Vertical Section 17 of the Frame 4 and is threadably engaged with the Ram 19. Rotating the Adjustment Wheel 20 causes the Ram 19 to translate vertically in relation to the Front Vertical Section 17 of the Frame 4. A Cradle 21 is rigidly joined to the top surface of the Ram 19. In one embodiment, the Cradle 21 is a stamped sheet metal platform that supports a bag 22 filled with sand, or other particulate media, that is shaped to fit the typical contour of a rifle forend 7. When the Adjustment Wheel 20 is rotated, the Ram 19 vertically moves causing corresponding movement of the Cradle 21 to adjust the vertical position of the rifle forend 7 to a desired position.

In one embodiment, the Holder 5 is formed of sheet metal and is rigidly connected to the Horizontal Base Section 14 of the Frame 4. Two Holder Support Tubes 26 are welded to Horizontal Section 14 to add support and stability to the Holder 5 by preventing it from rotating about the Horizontal Section. In the illustrated embodiment, the Holder 5 has a generally U-shaped cross-section with front and back Lips 18 that curve upward from a bottom surface 27 of the holder. The Holder 5 provides a stable platform to receive weights 8 placed on the Shooting Rest R by the shooter and a structure for the attachment of the Front Feet 23 to the Shooting Rest 1. It will be understood that the Holder 5 may comprise other structures for supporting the weights 8 on the Frame 4 or that the weights may be attached directly to the Frame without departing from the scope of this invention. In the illustrated embodiment, the weights 8 are in the form of 25 lb. bags of lead shot due to their availability to a typical marksman and ease of portability. However, other forms of additional weight may be used without departing from the scope of this invention. In the illustrated embodiment, the Holder 5 is designed to hold up to four bags of lead shot 8, but only two bags are shown loaded on the Holder. The lips 18 are sized to prevent the bags of lead shot 8 from shifting during rifle discharge.

All subsystems of the Shooting Rest 1 are joined via bolted or welded connections, for example, to form a rigidly constructed unit. With a weight of approximately 15 lbs., an overall length of approximately 25 inches and a height of approximately 13 inches the Shooting Rest 1 is easily portable. The only movable or adjustable components of the Shooting Rest 1 are the Front Support 3 and the Rear Foot 25. The Front Support 3 will adjust vertically to allow elevation sighting adjustments of the firearm R. The Rear Foot 25 also adjusts vertically to allow for leveling of the Rest 1 and elevation sighting adjustments of the firearm R.

Recoil energy is reduced when, according to the Law of Conservation of Momentum, the recoiling rifle encounters a greater opposing weight than merely the weight of the rifle alone. In the illustrated embodiment, the Holder 5 supports this opposing weight (represented by the four 25 lb. bags of Lead Shot 8), so that the Shooting Rest 1 reduces recoil energy when the firearm R is discharged.

The recoil-reducing aspect of the Shooting Rest 1 is created by adding weight to the unit to increase resistance to the recoil of the firearm. According to the Law of Conservation of Momentum, written below in terms pertaining to the discussion, the Recoil Energy of the firearm can be calculated from the following equation:

$$\text{Recoil Energy (ft-lbs)} = \frac{(\text{Bullet Weight} \times \text{Bullet Velocity} + 4700 \times \text{Gunpowder Weight})^2}{64.348 \times \text{Firearm Weight}}$$

Where 4700 is the velocity of the gases generated by the burning gunpowder and 64.348 is a correction factor for the acceleration of gravity.

Increasing the Firearm Weight in the above-stated formula will result in a decreased Recoil Energy. When the firearm is discharged, the firearm and the Recoil-reducing Shooting Rest 1 can be considered as a single unit subjected to the firearm's recoil. Mathematically, the weight of the shooting rest 1 can be added to the weight of the firearm R to yield a total Firearm Weight as used in the Recoil Energy equation. The more weight added to the rest 1, the higher the reduction in recoil. The Holder 5 is designed to accept up to four 25 lb. bags of lead shot 8 but other types of weights could be used to further increase the weight of the Shooting Rest 1. Twenty-five lb. bags of shot 8 are commonly available to the typical shooter and provide an easily portable system of weight addition for the Shooting Rest. Typically, the recoil energy of a firearm can be reduced by up to 90% by adding weight to the Shooting Rest 1. The amount of weight needed to provide a certain percentage of recoil reduction is dependant on the caliber and size of the firearm used on the Shooting Rest 1.

The general steps in the process of using the Shooting Rest 1 comprise:

1) Placing the Shooting Rest 1 on top of a relatively flat table or bench.

2) Placing weights 8 on the Holder 5 of the Shooting Rest 1.

3) Placing the firearm R atop the Shooting Rest 1 in such a manner that the buttstock 6 of the firearm rests in the Rear Support 2 while the Front Support 3 cradles the forend 7 of the firearm.

4) The Front Support 3 and/or Rear Foot 25 may be vertically adjusted to level the rest 1 or make elevation sighting adjustments of the firearm R.

5) The shooter will take a sitting position behind the Shooting Rest 1 and firearm R with the Rear Support 2 of the Shooting Rest closest to the shooter. The Shooting Rest 1 will be oriented such that an imaginary line connecting the Rear Support 2 and the Front Support 3 will be perpendicular to an imaginary line connecting the shooter's shoulders.

6) The shooter's shoulder will be placed against the Shoulder Rest 16 attached to the Rear Support 2.

7) The shooter will place both hands on the firearm R in a comfortable shooting position.

8) The shooter will pull the buttstock 6 of the firearm R towards the shoulder so as to make complete and firm contact with the inside surface 15 of the Rear Support 2.

9) The shooter will fire, or discharge, the firearm R.

10) Discharging the firearm R will cause the firearm to translate linearly, or recoil, in a rearward direction.

11) With the recoiling firearm R in firm contact with the Rear Support 2 the recoil energy of the firearm is transferred to the Shooting Rest 1.

12) The Shooting Rest 1 will translate linearly, or recoil, in a rearward direction. Due to the resistance offered by the weights 8 added to the Shooting Rest, the Shooting Rest will recoil with a significantly reduced velocity and energy than the firearm alone.

13) With the shooter in firm contact with the Shooting Rest 1 the shooter's upper body will in turn absorb the reduced recoil energy of the Shooting Rest.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense. For example, the Frame 4 may comprise materials other than steel tubing. Also, the Holder 5 may be an integral part of the Frame 4 or the Holder may be eliminated so that the weights 8 are supported directly on the Frame. Further, the weights 8 could be separate components attached to the Frame 4 or the weights may be integral with the Frame so that the weight of the Shooting Rest 1 is increased and the recoil energy transferred to a shooter is decreased.

In view of the above, it will be seen that the several objects of the invention are achieved and other advantageous results attained.

We claim:

1. A shooting rest for supporting a firearm having a first portion and a second portion rearward of the first portion, the shooting rest comprising:

a front support for supporting the first portion of the firearm;

a support member coupled to the front support, the support member including a surface for carrying one or more weights rearward of the front support and a portion positioned aft of the one or more weights to inhibit rearward movement of the one or more weights during recoil;

a rear support for supporting the second portion of the firearm, the rear support being coupled to the support member;

an inhibiting member for inhibiting rearward movement of the firearm relative to the shooting rest, at least a portion of the inhibiting member being positioned proximate to the rear support; and at least one of a weight configured to reduce recoil, wherein the weight is approximately twenty-five pounds.

2. The shooting rest of claim 1 wherein the support member is positioned between the front and rear supports.

3. The shooting rest of claim 1 wherein the support member has a U-shaped configuration.

4. The shooting rest of claim 1 wherein the portion includes a first portion projecting from the surface, wherein the support member further comprises a second portion projecting from the surface and spaced apart from the first portion, and wherein the first and second portions are positioned to retain the one or more weights on the support member.

5. The shooting rest of claim 1, further comprising a frame connecting the front and rear supports, and wherein the support member is attached to the frame.

6. The shooting rest of claim 1, further comprising a frame connecting the front and rear supports, and wherein the support member is a portion of the frame.

7. The shooting rest of claim 1 wherein the support member is configured such that the one or more weights can be placed on the support member while the front support carries the first portion of the firearm and the rear support carries the second portion of the firearm.

8. The shooting rest of claim 1 wherein the inhibiting member comprises a buttstop.

9. The shooting rest of claim 1 wherein the inhibiting member is positioned to contact the second portion of the firearm.

10. The shooting rest of claim 1 wherein the inhibiting member is coupled to the rear support.

11. The shooting rest of claim 1 wherein the inhibiting member is a component of the rear support.

* * * * *

UNITED STATES PATENT AND TRADEMARK OFFICE

CERTIFICATE OF CORRECTION

PATENT NO. : 8,011,129 B2
APPLICATION NO. : 10/865595
DATED : September 6, 2011
INVENTOR(S) : Dennis Cauley and Tim Morrow It is certified that error appears in the above-identified patent and that said Letters Patent is hereby corrected as shown below:

Title Page, under item [57] Abstract: 11 Claims should read 33 Claims, 5 Drawing Sheets.

In the Claims

Column 6, line 59, after "member;" insert --and--.

Column 6, line 63, cancel the text beginning with "; and" to and ending "twenty-five pounds" in column 6, line 65.

Column 8, line 15 after claim 11, insert the following claims 12-33:

--12. A shooting rest for supporting a firearm having a rear portion and a first portion forward of the rear portion, the shooting rest comprising:
a rear support positioned to carry the rear portion of the firearm;
a front support coupled to the rear support and positioned to carry the first portion of the firearm;
a support member coupled to at least one of the rear support or the front support, the support member including a surface for carrying a removable weight and a portion projecting from the surface to inhibit rearward movement of the removable weight during recoil; and
an inhibiting member coupled to at least one of the rear support or the support member, the inhibiting member configured to inhibit rearward movement of the firearm relative to the rear support.

13. The shooting rest of claim 12 wherein at least a section of the support member is positioned between the front and rear supports.

14. The shooting rest of claim 12 wherein the portion includes a first portion, wherein the support member further comprises a second portion projecting from the surface and spaced apart from the first portion, and wherein the first and second portions are positioned to retain the removable weight on the support member.

Signed and Sealed this
Twenty-fourth Day of March, 2015

Michelle K. Lee

Michelle K. Lee
*Director of the United States Patent and Trademark Office*

15. The shooting rest of claim 12 wherein the inhibiting member comprises a buttstop.

16. The shooting rest of claim 12 wherein the inhibiting member is positioned to contact the rear portion of the firearm.

17. A shooting rest for supporting a firearm having a first portion and a second portion rearward of the first portion, the shooting rest comprising:
a first support for supporting the first portion of the firearm;
a second support for supporting the second portion of the firearm, the second support being coupled to and spaced apart from the first support;
a support member for supporting a supplemental weight, the support member being configured to retain the supplemental weight on the support member, the support member being positioned at least partially between the first and second supports, the support member including a first portion for carrying the supplemental weight and a second portion transverse to the first portion, the second portion being configured to inhibit rearward movement of the supplemental weight during recoil; and
an inhibiting member for inhibiting rearward movement of the firearm relative to the second support, the inhibiting member being coupled to at least one of the second support or the support member.

18. The shooting rest of claim 17 wherein the support member has a U-shaped configuration.

19. The shooting rest of claim 17 wherein the support member further comprises a generally flat surface, and wherein the first and second portions project from the surface.

20. The shooting rest of claim 17, further comprising a frame connecting the first and second supports, and wherein the support member is attached to the frame.

21. The shooting rest of claim 17, further comprising a frame connecting the first and second supports, and wherein the support member is a portion of the frame.

22. A shooting rest for supporting a firearm having a first portion and a rear portion rearward of the first portion, the shooting rest comprising:
a frame;
a front support coupled to the frame, the front support being configured to carry the first portion of the firearm;
a rear support coupled to the frame, the rear support being configured to carry the rear portion of the firearm and inhibit rearward movement of the firearm relative to the rear support; and
means for supporting a removable weight and inhibiting rearward movement of the removable weight during recoil, the means for supporting being coupled to the frame.

23. The shooting rest of claim 22 wherein the means for supporting the removable weight comprise a support member having a U-shaped configuration.

24. The shooting rest of claim 22 wherein the means for supporting the removable weight comprise a support member having a generally flat surface and first and second portions projecting from the surface, and wherein the first and second portions are positioned to retain the removable weight on the support member.

25. The shooting rest of claim 22 wherein the means for supporting the removable weight comprise a support member configured such that the removable weight can be placed on the support member while the front support carries the first portion of the firearm and the rear support carries the rear portion of the firearm.

26. The shooting rest of claim 22 wherein the rear support comprises a buttstop to inhibit rearward movement of the firearm relative to the rear support.

27. A method of manufacturing a shooting rest for supporting a firearm having a first portion and a second portion rearward of the first portion, the method comprising:
coupling a front support to a frame with the front support positioned to support the first portion of the firearm;
attaching a rear support to the frame with the rear support positioned to support the second portion of the firearm;
coupling a support member to the frame with a surface of the support member configured to carry a removable weight and a projection of the support member positioned to inhibit rearward movement of the removable weight during recoil; and
attaching an inhibiting member to at least one of the rear support or the frame with the inhibiting member positioned to inhibit rearward movement of the firearm relative to the shooting rest.

28. The method of claim 27 wherein coupling the support member comprises positioning the support member between the front and rear supports.

29. The method of claim 27 wherein coupling the support member comprises attaching a support member having a U-shaped configuration to the frame.

30. The method of claim 27 wherein coupling the support member comprises attaching to the frame a support member having first and second portions projecting from the surface.

31. The method of claim 27 wherein attaching the inhibiting member comprises coupling a buttstop to the rear support.

32. The method of claim 27 wherein attaching the inhibiting member comprises positioning the inhibiting member to contact the second portion of the firearm.

33. The method of claim 27 wherein attaching the inhibiting member comprises coupling the inhibiting member to the rear support.--.